United States Patent [19]

Nishi et al.

[11] Patent Number: 4,635,048

[45] Date of Patent: Jan. 6, 1987

[54] VIDEO DISPLAY CONTROLLER

[75] Inventors: Kazuhiko Nishi; Takatoshi Ishii; Ryozo Yamashita, all of Tokyo; Shigemitsu Yamaoka; Takatoshi Okumura, both of Hamamatsu, all of Japan

[73] Assignees: Ascii Corporation, Tokyo; Nippon Gakki Seizo Kabushiki Kaisha, Hamamatsu, both of Japan

[21] Appl. No.: 698,877

[22] Filed: Feb. 6, 1985

[30] Foreign Application Priority Data

Feb. 8, 1984 [JP] Japan ..... 59-021334

[51] Int. Cl.[4] ..... G09G 1/16

[52] U.S. Cl. ..... 340/703; 340/701; 340/748; 340/750; 340/799

[58] Field of Search ..... 340/701, 703, 747, 748, 340/750, 798, 799, 723

[56] References Cited

U.S. PATENT DOCUMENTS

| | | | |
|---|---|---|---|
| 3,911,418 | 10/1975 | Takeda | 340/703 |
| 4,149,152 | 4/1979 | Russo | 340/703 |
| 4,439,759 | 3/1984 | Fleming et al. | 340/703 |
| 4,447,809 | 5/1984 | Kodama | 340/750 |

FOREIGN PATENT DOCUMENTS

| | | | |
|---|---|---|---|
| 52-27325 | 3/1977 | Japan | 340/703 |

*Primary Examiner*—Gerald L. Brigance

*Attorney, Agent, or Firm*—Cushman, Darby & Cushman

[57] ABSTRACT

A video display controller which can display foregrounds as well as backgrounds of display patterns on a screen of a video display unit in a plurality of colors. The video display controller comprises a plurality of color information registers, in each of which a pair of color code data representative of foreground and background colors of one display pattern are stored. A memory is provided for storing a plurality of pattern data, a plurality of pattern name data each designating one of the display patterns to be displayed on a respective one of display portions of the screen, and a plurality of color selection data each corresponding to a respective one of the display portions. A sequence controller sequentially reads the pattern data designated by the pattern name data and the color selection data in accordance with synchronization signals. A color selection control logic circuit selects one of the color information registers in accordance with the color selection data read from the memory, and reads one of the pair of color code data from the selected color information register. A color signal generator generates a color signal in accordance with the color code data read from the register and supplies it to the video display unit.

7 Claims, 7 Drawing Figures

| Color code | color deta | | | color |
|---|---|---|---|---|
| | GD | RD | BD | |
| 0 0 0 0 | 0 0 0 | 0 0 0 | 0 0 0 | black |
| 0 0 0 1 | 0 0 0 | 0 0 0 | 0 1 0 | dark blue |
| 0 0 1 0 | 0 0 0 | 0 1 0 | 0 0 0 | dark red |
| 0 0 1 1 | 0 0 0 | 0 1 0 | 0 1 0 | dark mazenta |
| 0 1 0 0 | 0 1 0 | 0 0 0 | 0 0 0 | dark green |
| 0 1 0 1 | 0 1 0 | 0 0 0 | 0 1 0 | dark yellow |
| 0 1 1 0 | 0 1 0 | 0 1 0 | 0 0 0 | dark cyan |
| 0 1 1 1 | 0 1 0 | 0 1 0 | 0 1 0 | gray |
| 1 0 0 0 | 1 0 0 | 1 1 1 | 0 1 0 | beige |
| 1 0 0 1 | 0 0 0 | 0 0 0 | 1 0 0 | blue |
| 1 0 1 0 | 0 0 0 | 1 0 0 | 0 0 0 | red |
| 1 0 1 1 | 0 0 0 | 1 0 0 | 1 0 0 | mazenta |
| 1 1 0 0 | 1 0 0 | 0 0 0 | 0 0 0 | green |
| 1 1 0 1 | 1 0 0 | 0 0 0 | 1 0 0 | yellow |
| 1 1 1 0 | 1 0 0 | 1 0 0 | 0 0 0 | cyan |
| 1 1 1 1 | 1 0 0 | 1 0 0 | 1 0 0 | white |

VIDEO DISPLAY CONTROLLER

BACKGROUND OF THE INVENTION

1. Field of the Invention

This invention relates to a video display controller adapted to be connected to a video display unit such as a video monitor for displaying color display patterns on a screen of the video display unit.

2. Prior Art

In recent years, video display controllers which are able to display both of still and animation pattern images on screens of video display units have been extensively used in graphic video display apparatuses such as video game machines. When displaying a still pattern image, such a video display controller operates in a character mode besides other display modes to display character patterns smaller in size than those used in the other display modes. Each of the character patterns used in the character mode is composed of, for example, $8\times6$ pixels in the case where each of display patterns used in the other modes is composed of $8\times8$ pixels. And therefore, character patterns greater in number than the patterns displayed in the other modes can be displayed on a screen in the character mode, whereby more information can be given through the screen. However, the conventional video display controller is so constructed that only a pair of selected colors are used for the display of the patterns on the screen in the character mode. In this case, foreground or information portion of each of the character patterns is displayed in one of the selected colors, while background of each of the character patterns is displayed in the other of the selected colors. Thus, the conventional video display controller is disadvantageous in that the patterns displayed on the screen in the character mode are somewhat monotonous.

SUMMARY OF THE INVENTION

It is therefore an object of the present invention to provide a video display controller by which foregrounds as well as backgrounds of display patterns can be displayed on the screen in a plurality of colors.

It is another object of the present invention to provide a video display controller which can periodically change colors of foreground and background of a display pattern on each of selected display portions of a screen to thereby establish blinking of display patterns in a part or the whole of area of the screen.

According to the present invention, there is provided a video display controller, which is adapted to be connected to a video display unit for displaying each of selected ones of a plurality of display patterns on a respective one of display portions of a screen of the video display unit in accordance with synchronization signals generated therein, comprising a color information register section comprising a plurality of registers each for storing a pair of color code data representative of colors of a foreground and a background of a display pattern; a memory having first, second and third memory areas, the first memory area storing a plurality of pattern data each corresponding to a respective one of the plurality of display patterns, the second memory area storing a plurality of pattern name data each designating one of the display patterns to be displayed on a respective one of the display portions of the screen, and the third memory area storing a plurality of color selection data each corresponding to a respective one of the display portions of the screen; a sequence control circuit responsive to the synchronization signals for sequentially reading the pattern name data and color selection data from the second and third memory areas, the sequence control circuit reading from the first memory area pattern data designated by the pattern name data read from the second memory; a color selection control circuit for selecting one of the registers in accordance with the read color selection data and for reading one of the pair of color code data from the selected register in accordance with the pattern data read from the first memory; and a color signal generating circuit responsive to the color code data read from the selected register for generating a color signal corresponding thereto, the color signal being supplied to the video display unit; whereby each of the display patterns designated by the pattern name data is displayed on the screen in the pair of colors selected by the respective one of the color selection data in the third memory area of the memory. In the case where the color information register section comprises first and second registers, the video display controller may further comprise a timer circuit responsive to the synchronization signals for generating a pulse signal at a predetermined time interval, the pulse signal changing the color selection data of "1" read from the third memory area into "0" in response to the pulse signal, whereby foreground and background colors of a display pattern on a display portion corresponding to the color selection data of "1" alternate between a pair of colors indicated by color code data in the first register and another pair of colors indicated by color code data in the second register.

DESCRIPTION OF THE PREFERRED EMBODIMENT OF THE INVENTION

Figure 1:
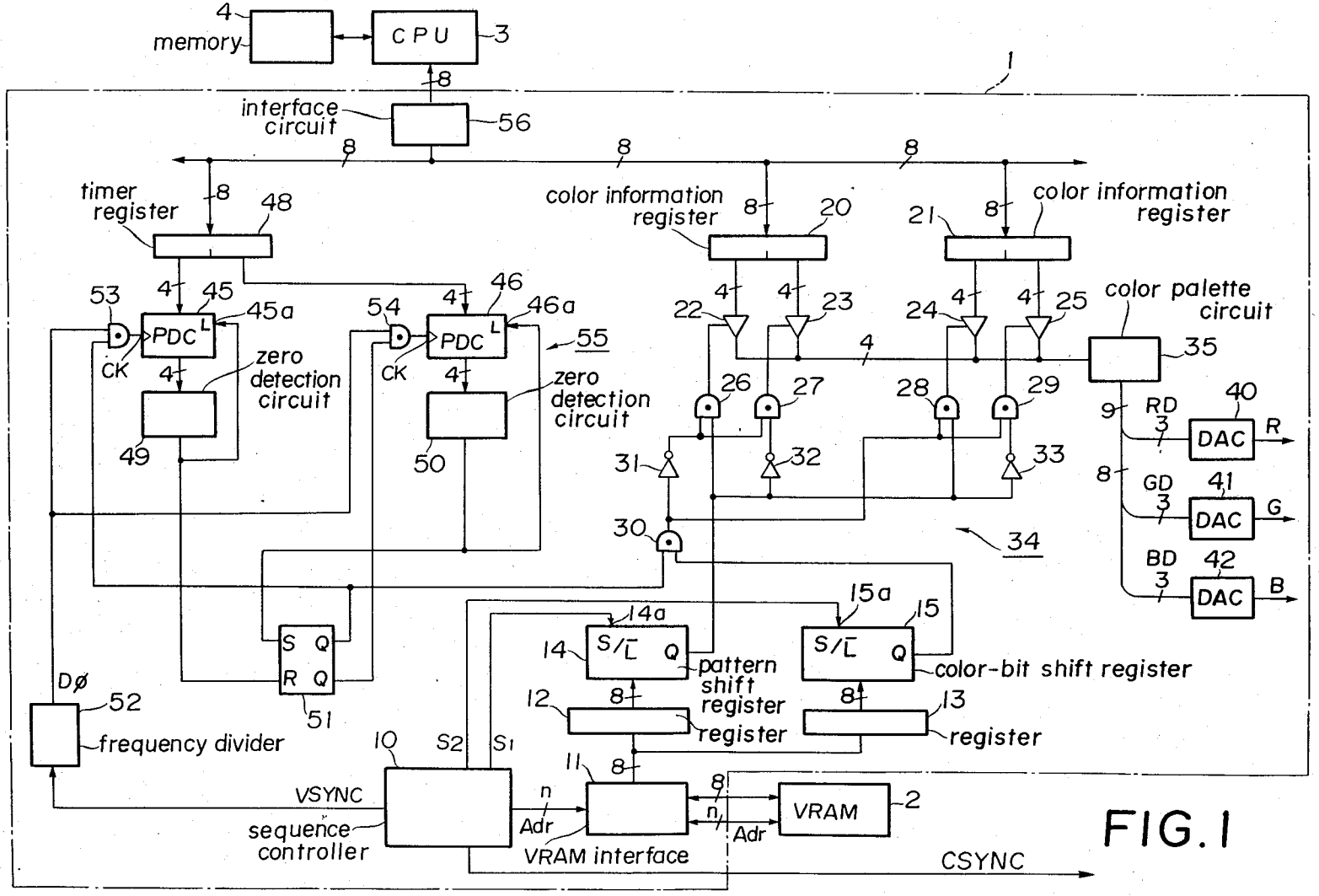
FIG. 1 is a block diagram of a video display controller provided in accordance with the present invention.

Shown in FIG. 1 is a video display controller provided in accordance with the present invention. This video display controller comprises a display data processor 1 for displaying color video images on a screen of a video display unit (not shown) in accordance with contents of a video RAM (hereinafter referred to as VRAM) 2, the video images being changed by control commands executed by a central processing unit (CPU) 3. Various programs to be executed by the CPU 3 to display the video images on the screen are stored in a memory 4.

Figure 2:
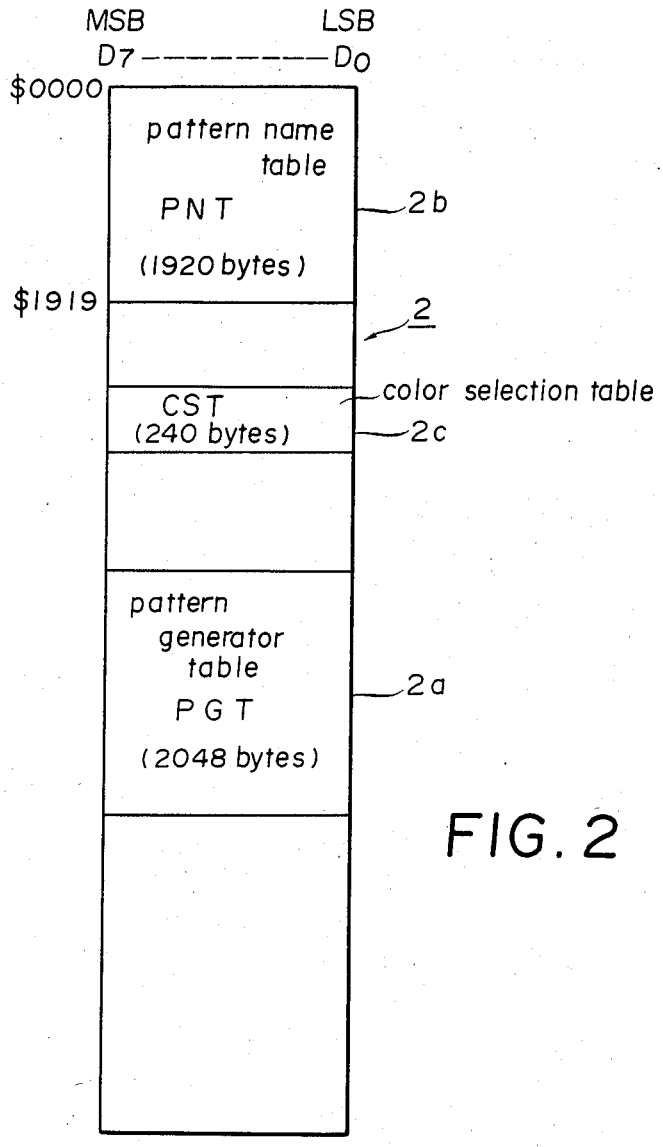
FIG. 2 is an illustration showing the VRAM 2 of the video display controller of FIG. 1.
Figure 3:
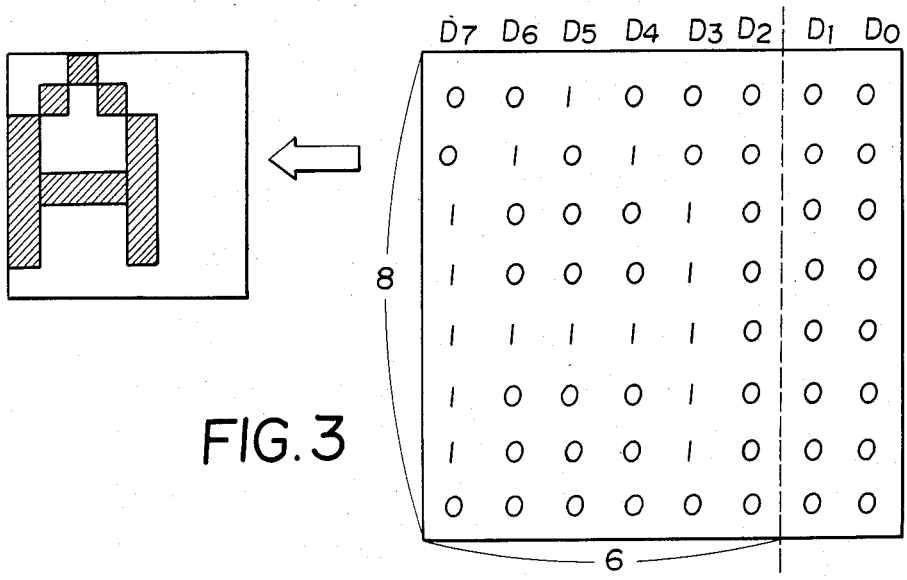
FIG. 3 is an illustration showing one example of display patterns storeq in a pattern generator table of VRAM 2.
Figure 4:
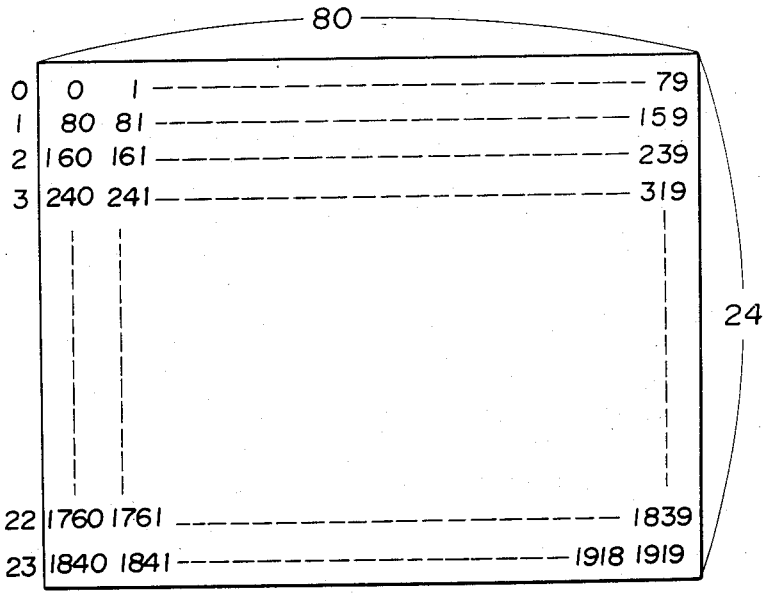
FIG. 4 is an illustration showing display portions on a screen of a video display unit connected to the video display controller of FIG. 1.
Figures 5, 6:
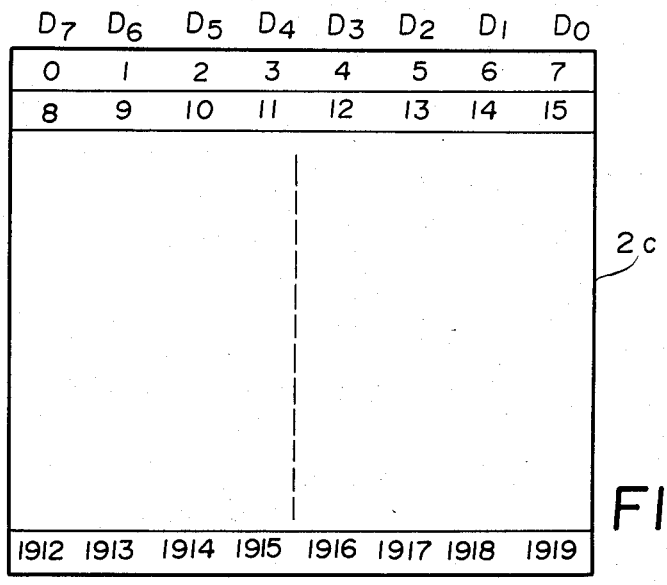
FIG. 5 is an illustration showing the relationship between colpr codes and color data used in the controller of FIG. 1 and the relationship between the color data and colors on the screen.
FIG. 6 is an illustration showing the color selection table stored in the VRAM 2 of the video display controller of FIG. 1.

VRAM 2 is a random access memory having a plurality of addresses each composed of eight bits, as shown in FIG. 2, and stores a pattern generator table (PGT) 2a, a pattern name table (PNT) 2*b* and a color selection table (CST) 2*c*. Stored in the PGT 2*a* are data representative of display patterns such as patterns of alphabetic and numeric characters. Pattern data representative of each of the display patterns are stored in the PGT 2*a* using eight consecutive addresses which form a pattern definition block. Lower two bits of each of the pattern definition blocks in the PGT 2*a* are not used since each of the display patterns is composed of 8×6dots. FIG. 3 shows the relationship between a display pattern of an alphabetic character "A" and data representative of the character "A" and stored in a pattern definition block in the PGT 2*a*. As is appreciated from FIG. 3, bits "1" in a pattern definition block in the PGT 2*a* represent a foreground or an image portion of the display pattern, while bits "0" represent a background of the display pattern, and the lower two bits $D_1$ and $D_0$ of each of the addresses in the pattern definition block are not included in the display pattern. The PGT 2*a* has a capacity of 2048 bytes for storing 256 (=2048/8) kinds of display patterns. The PNT 2*b* occupies addresses "0000" to "1919" of the VRAM 2, in each of which a data representative of a name of a selected one of the display patterns is stored. FIG. 4 shows a screen of the display unit which screen is divided into eighty columns of twenty four rows of display portions when this video display controller operates in a character mode. In the character mode, a selected one of the display patterns is displayed on one of the display portions. The addresses "0000" to "1919" of the PNT 2*b* shown in FIG. 2 correspond to the display portions "0" to "1919" shown in FIG. 4, respectively, and each of the addresses of the PNT 2*b*contains a name data indicative of a selected one of the display patterns stored in the PGT 2*a*. In the case where the display patterns to be displayed on the screen are character patterns such as patterns of alphanumeric characters, the name data to be stored in the PNT 2*b* may be code data such as ASCII codes. The PNT 2*b* has a capacity of 1920 bytes since the addresses of the PNT 2*b* correspond to the display portions "0" to "1919" , respectively. The CST 2*c* shown in FIG. 2 has a capacity of 240 bytes, and each of bits of the CST 2*c* corresponds, as shown in FIG. 6, to a respective one of the display portions "0" to "1919".

The display data processor 1 shown in FIG. 1 has a sequence controller 10 which controls most of circuit portions of the display data processor 1 and outputs various signals such as an address data signal Adr indicative of a selected one of the addresses of the VRAM 2, and a composite synchronization signal CSYNC and a vertical synchronization signal VSYNC both necessary for a raster scan on the screen of the video display unit. A VRAM interface 11 of the processor 1 supplies data outputted from the VRAM 2 to a register 12 or a register 13. More specifically, the VRAM interface 11 is constructed so as to supply data read from the PGT 2*a* to the register 12 and to supply data read from the CST 2*c* to the register 13. A pattern shift register 14 stores an eight-bit data fed from the register 12 and shifts it so that the stored data is serially outputted from an output terminal Q of the MSB of the pattern shift register 14. The pattern shift register 14 stores the eight-bit data thereinto when a signal S1 applied to a control input terminal 14*a* thereof is in a "0" state and shifts the stored data when the signal S1 is in a "1" state. A color-bit shift register 15 is similar in construction to the pattern shift register 14. Each of color information registers 20 and 21 has a capacity of eight bits and temporarily stores color information, the registers 20 and 21 being selectively used under the control of a logic circuit described below. The upper four bits of each of the color information registers 20 and 21 are supplied with a four-bit color code representative of a color of the foreground of a display pattern, i.e., a color code representative of a color of each of dots indicated by bits "1" in FIG. 3. On the other hand, the lower four bits of each of the color information registers 20 and 21 are supplied with a color code representative of a color of the background of a display pattern, i.e., a color code representative of a color of each of dots indicated by bits "0" in FIG. 3. A logic circuit 34 comprised of bus drivers 22 to 25 of a three-state output type, AND gates 26 to 30 and inverters 31 to 33 selects one of the color information registers 20 and 21 and also selects upper four bits or lower four bits of the selected color information register. A color palette circuit 35 decodes a color code supplied thereto through one of the drivers 22 to 25 into three color data RD, GD and BD indicative of intensities of red (R), green (G) and blue (B). The color data RD, GD and BD each composed of three bits are supplied to digital-to-analog converters (DACs) 40 to 42 which convert the color data RD, GD and BD into analog color signals R, G and B, respectively. FIG. 5 shows the relationship between the color codes and the color data RD, GD and BD, and also shows the relationship between the color data RD, GD and BD and colors displayed on the screen of the video display unit.

A pre-set down-counter (PDC) 45 stores output data of upper four bits of an eight-bit type timer register 48 when "1" signal is applied to a load terminal 45*a* thereof, and decrements the stored data each time a clock signal is applied to a clock input terminal CK of the PDC 45. Similarly, a PDC 46 stores output data of lower four bits of the timer register 48 when "1" signal is applied to a load terminal 46*a* thereof, and decrements the stored data each time a clock signal is applied to a clock input terminal CK of the PDC 46. A zero detection circuit 49 outputs a "1" signal when a four-bit output data of the PDC 45 becomes equal to "0000", while a zero detection circuit 50 outputs a "1" signal when an output data of the PDC 46 becomes equal to "0000". The output signal of the zero detection circuit 49 is supplied to the load terminal 45*a* of the PDC 45 and is also applied to a reset input terminal R of an SR flip-flop (FF) 51 in which a set operation has a higher priority than a reset operation. The output signal of the zero detection circuit 50 is supplied to the load terminal 46*a* of the PDC 46 and is also supplied to a set input terminal S of the FF 51. A frequency divider 52 divides the frequency of the vertical synchronization signal VSYNC having a period of 16.6 msec and outputs a clock signal DØ having a period of 166 msec , the clock signal DØ being supplied to the PDCs 45 and 46 via AND gates 53 and 54. The above described circuit elements 45 to 54 constitute a blinking control section 55 in this display data processor 1.

The CPU 3 is designed so as to supply necessary data to each of the color information registers 20 and 21 and the timer register 48 through an interface circuit 56. The display data processor 1 further includes circuit portions for storing under the control of the sequence controller 10 output data of the CPU 3 into the VRAM 2 via the VRAM interface 11, however, the circuit portions do not constitute an important part of this invention and therefore will not be described here.

The operation of this video display controller will now be described.

(1) The operation of the video display controller in the case where the timer register 48 is cleared will be first described. In this case, the output data of the PDC 46 is always equal to "0000" and therefore the zero detection circuit 50 outputs a "1" signal, so that the FF 51 is kept in a set state. As a result, a "1" signal is outputted from a set output terminal Q of the FF 51, and therefore the state of an output signal of the AND gate 30 is determined only by the output signal of the color-bit shift register 15. Assuming that the output signal of the color-bit shift register 15 is in a "1" state, the AND gate 30 outputs a "1" signal which enables the AND gates 28 and 29 to open and disables the AND gates 26 and 27. In this condition, when a "1" signal is outputted from the pattern shift register 14, the AND gate 28 outputs a "1" signal, whereby a color code stored in the upper four bits of the color information register 21 is supplied to the color palette circuit 35. On the other hand, when a "0" signal is outputted from the pattern shift register 14, a color code stored in the lower four bits of the color information register 21 is supplied to the color palette circuit 35. On the contrary, in the case where the output signal of the color-bit shift register 15 is in a state of "0", the AND gates 26 and 27 are enabled while the AND gates 28 and 29 are disabled. In this condition, when a "1" signal is outputted from the pattern shift register 14, a color code stored in the upper four bits of the color information register 20 is supplied to the color palette circuit 35, and, on the other hand, when a "0" signal is outputted from the pattern shift register 14, a color code stored in the lower four bits of the color information register 20 is supplied to the color palette circuit 35. As described above, in the case where the timer register 48 is cleared, one of the color information registers 20 and 21 is selected by the output signal of the color-bit shift register 15, and then one of the two color codes stored in the upper and lower four bits of the selected color information register is selected by the output signal of the pattern shift register 14.

As described above, the eight-bit pattern data read from the PGT **2*a* is loaded in the register 12, and the loaded data is serially outputted therefrom. Incidentally, bits "1" of the data serially outputted from the pattern shift register 14 correspond to the foreground of the display pattern to be displayed, while bits "0" of the data correspond to the background of the display pattern. And therefore, the color of the foreground of the display pattern is determined by the color code contained in the upper four bits of the selected one of the color information registers 20 and 21, while the color of the background of the display pattern is determined by the color code contained in the lower four bits of the selected one of the color information registers 20 and 21**.

Figure 7:
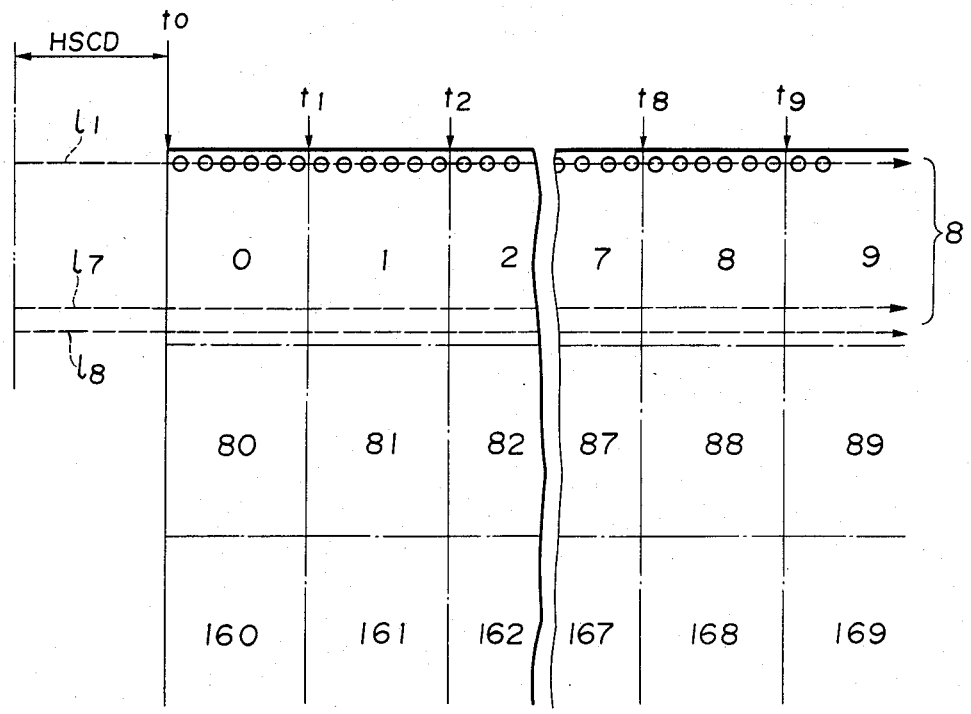
FIG. 7 is an illustration showing the relationship between the display portions and scanning lines on the screen.

The shift and load timings of the pattern shift register 14 and color-bit shift register 15 will now be described. The relationship between the display portions and scanning lines on the screen is shown in FIG. 7, wherein each of circles represents a display dot and each of broken lines represents a scanning line. Each of the display portions includes therein portions of eight consecutive scanning lines, and has six display dots on each of the portions of the eight scanning lines. A time period HSCD shown in FIG. 7 is a part of a horizontal scanning period to be lapsed before an active display in the horizontal scanning period is commenced at time $t_0$.

Reference is first made to the uppermost scanning line $l_1$. Before an active display is commenced at time $t_0$, the sequence controller 10 has an access to the address "0000" of the VRAM 2 or the first address of PNT **2*b* to read a pattern name data stored in that address. The sequence controller 10 then reads a pattern data stored in the first address of a pattern definition block designated by the pattern name data, and supplies the pattern data to the register 12. If the display pattern in the pattern definition block designated by the pattern name data is the pattern of a character "A" shown in FIG. 3, the pattern data stored in the register 12 will be "00100000". The sequence controller 10 then reads a data in the first address of the CST 2*c* and supplies the read data to the register 13. At time $t_0$, the sequence controller 10 renders both of the signals S1 and S2 "0" so that the display pattern data in the register 12 and the data in the register 13 are loaded into the pattern shift register 14 and the color-bit shift register 15, respectively. Then, the pattern shift register 14 begins to shift the loaded display pattern data to serially output it from the MSB thereof at a time interval corresponding to the speed of the horizontal scan. On the other hand, the color-bit shift register 15 shifts the loaded data by one bit each time six consecutive shift operations have been made by the pattern shift register 14. As a result, one of the color information registers 20 and 21 is selected by the MSB of the data contained in the first address of the CST 2*c* (see FIG. 6) during the time period between the time $t_0$ and $t_1$ when six consecutive dots are displayed on the scanning line $l_1$. During this time period, the sequence controller 10 reads a pattern name data in address "0001" of the PNT 2*b*. Then, the controller 10 reads a display pattern data in the first address of a pattern definition block designated by the pattern name data read from the address "0001" of the PNT 2*b*, and supplies the display pattern data to the register 12. The sequence controller 10 renders the signal S1 "0" at time $t_1$ so that the display pattern data in the register 12 is loaded into the pattern shift register 14. Immediately after the loading of the pattern data into the pattern shift register 14 is completed, the sequence controller 10 renders the signal S1 "1" so that the pattern shift register 14 is brought into a shift mode. Thereafter, the above operation is repeated. When eight one-bit shift operations have been completed by the color-bit shift register 15, the sequence controller 10 reads a data contained in the next address of the CST 2*c* and supplies the read data to the register 13. Immediately before the ninth shift operation is initiated by the colorbit shift register 15 at time $t_8$, the sequence controller 10 renders the signal S2 "0" for a predetermined period of time so that the data in the register 13 is loaded into the color-bit shift register 15, and thereafter the above operation is repeated. As will be clear to those skilled in the art, data contained in the first to tenth addresses of the CST 2*c*** with respect to each row on the screen are sequentially used eight times during the display operation for the first to eightieth display portions of each row on the screen.

As described above, the foreground of a display pattern at a display portion to which a bit "1" is allotted in the CST **2*c* is displayed in a color determined by a color code contained in the upper four bits of the information register 21, while the background of the display pattern is displayed in a color determined by a color code contained in the lower four bits of the color information register 21**. On the other hand, the foreground of a display pattern at a display portion to which a bit "0" is allotted in the CST *2c* is displayed in a color determined by a color code contained in the upper four bits of the information register 20, while the background of the display pattern is displayed in a color determined by a color code contained in the lower four bits of the color information register 20. Incidentally, with the construction of this video display controller, the pattern data and the color selection data for the next display portion of the screen can be stored in the registers 12 and 13, respectively, immediately before the display on the next display portion is commenced.

(2) The operation of the video display controller in the case where a data is stored in the timer register 48 will now be described. When a data is stored in the timer register 48, the upper four bits and the lower four bits of the stored data are supplied to the PDCs 45 and 46, respectively. As a result, both of the zero detection circuits 49 and 50 output "0" signals which bring the PDC 45 and 46 into down-count modes. Before the data is loaded into the timer register 48, the FF 51 has been outputting a "1" signal from the set output terminal Q thereof, and therefore at the time when both of the PCDs 45 and 46 are brought into down-count modes, the clock signal DÅ is supplied via the AND gate 53 to the PDC 45 but is not supplied to the PDC 46. As a result, the PDC 45 begins to decrement the contents thereof, and when the contents of the PDC 45 become equal to "0000" the zero detection circuit 49 outputs a "1" signal. This "1" signal causes the data in the upper four bits of the timer register 48 to be loaded into the PDC 45 again and, at the same time, brings the FF 51 into a reset state. Consequently, a "1" signal is outputted from the reset output terminal Q of the FF 51, which signal allows the clock signal DÅ to be supplied via the AND gate 54 to the PDC 46. The PDC 46 therefore begins to count downwardly the clock pulse DÅ applied thereto. When the contents of the PDC 46 become equal to "0000", the zero detection circuit 50 outputs a "1" signal. This "1" signal causes the data in the lower four bits of the timer register 48 to be loaded into the PDC 46 again and, at the same time, brings the FF 51 into a set state. This set state of the FF 51 allows the clock pulse DÅ to be supplied to the PDC 45, so that the PDC 45 begins to count downwardly the clock pulse DÅ. Thereafter, the above operation is repeated. Thus, the state of the signal outputted from the set output terminal Q of the FF 51 alternates between "0" and "1", and during each of the periods when the signal is "1" the PDC 45 performs down-count operation of the clock signal DÅ, and during each of the periods when the signal is "0" the PDC 45 performs down-count operation of the clock signal DÅ. It will be appreciated from the above description that the time length of the "1" state of the signal at the terminal Q of the FF 51 is determined by the data in the upper four bits of the timer register 48, and that the time length of the "0" state of the same signal is determined by the data in the lower four bits of the timer register 48.

Assuming that the output signal of the color-bit shift register 15 is "1", the color information registers 20 and 21 are alternately used in accordance with the alternation of the state of the signal outputted from the terminal Q of the FF 51. In other words, a color of each of the foreground and background of a display pattern on a display portion to which a bit "1" is allotted in the CST *2c* changes at a time interval determined by the data stored in the timer register 48, whereby blinking of the display pattern is established.

What is claimed is:

1. A video display controller adapted to be connected to a video display unit for displaying each of selected ones of a plurality of display patterns on a respective one of display portions of a screen of the video display unit in accordance with synchronization signals generated therein, said video display controller comprising:

(a) color information register means comprising a plurality of registers each for storing a pair of color code data representative of colors of a foreground and a background of a display pattern;

(b) memory means having first, second and third memory areas, said first memory area storing a plurality of pattern data each corresponding to a respective one of the plurality of display patterns, said second memory area storing a plurality of pattern name data each designating one of the display patterns to be displayed on a respective one of the display portions of the screen, and said third memory area storing a plurality of color selection data each corresponding to a respective one of the display portions of the screen;

(c) sequence control means responsive to the synchronization signals for sequentially reading said pattern name data and color selection data from said second and third memory areas, said sequence control means reading from said first memory area pattern data designated by the pattern name data read from said second memory area;

(d) color selection control means for selecting one of said registers in accordance with said color selection data read from the third memory area and for reading one of the pair of color code data from the selected register in accordance with said pattern data read from said first memory area; and (e) color signal generating means responsive to said color code data read from the selected register for generating a color signal corresponding thereto, said color signal being supplied to the video display unit;

(f) whereby each of the display patterns designated by said pattern name data is displayed on the screen in the pair of colors selected by the respective one of the color selection data in the third memory area of said memory means.

2. A video display controller according to claim 1, wherein said color information register means comprises a first and a second register, each of said color selection data being composed of one bit, a color selection data of "1" read from said third memory area selecting said first register, and a color selection data of "0" read from said third memory area selecting said second register.

3. A video display controller according to claim 2 further comprising timer means responsive to the synchronization signals for generating a pulse signal at a predetermined time interval, said pulse signal changing said color selection data of "1" read from said third memory area into "0" in response to the pulse signal, whereby foreground and background colors of a display pattern on a display portion corresponding to the color selection data of "1" read from said third memory area alternate between a pair of colors indicated by color code data in said first register and another pair of colors indicated by color code data in said second register.

4. A video display controller according to claim 2, wherein said sequence control means comprises third and fourth registers and first and second shift registers and generates a shift timing signal synchronized with said synchronization signals, said third and fourth registers temporarily storing the pattern data read from said first memory area and the color selection data read from said third memory area, respectively, said first shift register being supplied with said stored pattern data and serially outputting it bit by bit in accordance with said shift timing signal, said second shift register being supplied with said stored color selection data and serially outputting it bit by bit each time the serial output of said pattern data is completed by said first shift register.

5. A video display controller according to claim 3, wherein said timer means comprises a clock generator means responsive to said synchronization signals for generating a clock signal, a timer register for being supplied with first and second timer data, and first and second pre-set counter means connected to each other so as to alternately operate to generate said pulse signal, said first and second timer data being supplied as pre-set data to said first and second preset counter means, respectively, whereby said foregound and background colors of the display pattern alternate between said pairs of colors at time intervals determined by said first and second timer data.

6. A video display controller according to claim 3, wherein said sequence control means comprises third and fourth registers and first and second shift registers and generates a shift timing signal synchronized with said synchronization signals, said third and fourth registers temporarily storing the pattern data read from said first memory area and the color selection data read from said third memory area, respectively, said first shift register being supplied with said stored pattern data and serially outputting it bit by bit in accordance with said shift timing signal, said second shift register being supplied with said stored color selection data and serially outputting it bit by bit each time the serial output of said pattern data is completed by said first shift register.

7. A video display controller according to claim 6, wherein said timer means comprises a clock generator means responsive to said synchronization signals for generating a clock signal, a timer register for being supplied with first and second timer data, and first and second pre-set counter means connected to each other so as to alternately operate to generate said pulse signal, said first and second timer data being supplied as pre-set data to said first and second pre-set counter means, respectively, whereby said foreground and background colors of the display pattern alternate between said pairs of colors at time intervals determined by said first and second timer data.

* * * * *